United States Patent [19]

Cope

[11] Patent Number: 4,877,334

[45] Date of Patent: Oct. 31, 1989

[54] INFLATABLE BAG

[76] Inventor: Dennis Cope, 1621 Westminster Dr., Apt. 210, Naperville, Ill. 60540

[21] Appl. No.: 237,340

[22] Filed: Aug. 29, 1988

[51] Int. Cl.[4] ..... B65D 30/00

[52] U.S. Cl. ..... 383/3; 383/37; 383/38; 206/522; 229/DIG. 3

[58] Field of Search ..... 383/3, 37, 38, 40, 41, 383/1.0; 206/522; 229/DIG. 3

[56] References Cited

U.S. PATENT DOCUMENTS

| | | | |
|---|---|---|---|
| 4,155,453 | 5/1979 | Ono | 206/522 |
| 4,240,556 | 12/1980 | Field | 383/3 |
| 4,262,801 | 4/1981 | Avery | 383/3 |
| 4,465,188 | 8/1984 | Soroka | 383/3 |

*Primary Examiner*—Willis Little

[57] ABSTRACT

The present invention relates in general to a new and improved inflatable package and to a method of manufacturing the package.

7 Claims, 2 Drawing Sheets

INFLATABLE BAG

BACKGROUND OF THE INVENTION

It has been known to utilize inflatable compartments for protecting articles from shock, to reduce heat transfer and for purposes of flotation. Moreover, pouches or bags incorporating gas inflated external compartments for protecting the contents of the bags or pouches have been designed in the past as evidenced, for example, by U.S. Pat Nos. 4,155,453, 4,184,596 and 4,262,801, but such designs have not been used to any appreciable extent.

The inflatable packages of the prior art have been unattractive in appearance and expensive to manufacture, requiring special equipment and not being well suited for use with present day automated quantity production techniques. There is, therefore, a need for inflatable packages which can be inexpensively produced and which are attractive in appearance so as to enable their widespread use for many applications including gift wrapping.

SUMMARY OF THE INVENTION

Briefly, in accordance with the present invention there is provided a novel bag including a pair of separately inflatable compartments located on opposite sides of a central pouch. The pouch has a sealable opening at one end and is adapted to receive one or more articles to be packaged. The bag consists of four sheets of gas impervious plastic, each sheet preferably having one metallic surface, sealed together along three edges with the fourth edge of each of the outer sheets being respectively sealed to the fourth edge of the adjacent inner sheet. A pressure sensitive adhesive strip is affixed to the inner side of one of the inner sheets adjacent the fourth edge thereof for subsequently bonding the fourth edges of the two inner sheets together after an article to be packaged has been placed in the chamber between the inner sheets.

A pair of thin plastic inflation tubes respectfully incorporating unidirectional valve means sealably extend through one of the edges of the pouch into the respective spaces between the inner and outer sheets to facilitate simultaneous inflation of the said spaces by exhaling into the inflation tubes. After the two compartments have been inflated the distal ends of the inflation tubes which extend outwardly beyond the edge of the pouch can be cut off using scissors or the like to improve the appearance of the package.

The pouch of the present invention can be manufactured using standard pouch making machinery used in the method described in detail hereinafter.

In a preferred embodiment of the invention there is provided a small plastic piece incorporating a mouthpiece and two tubular extensions for respective and simultaneous insertion into the two inflation tubes for facilitating inflation of the pouch. Also, the plastic sheets are preferably formed of biaxially oriented sheets and a short slit or notch is cut in one edge of the bag in proximity to the fourth edge to permit tearing off of one end of the pouch to deflate the outer compartments and simultaneously to open the inner compartment to gain access to the packaged article.

GENERAL DESCRIPTION OF THE DRAWINGS

Further objects and advantages and a better understanding of the present invention will be had by reference to the following detailed description taken in connection with the accompanying drawings wherein.

Figure 1:
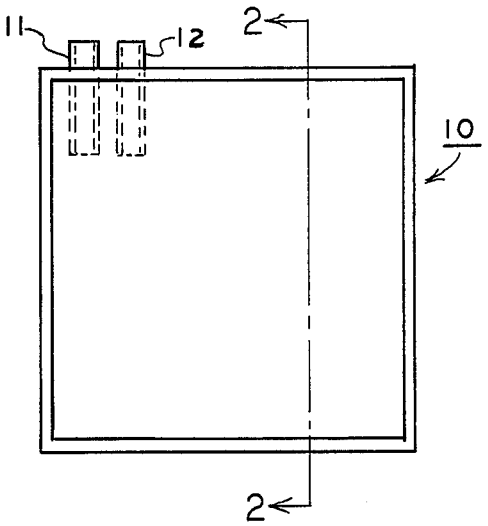
FIG. 1 is plan view of a bag embodying the present invention.
Figure 4:
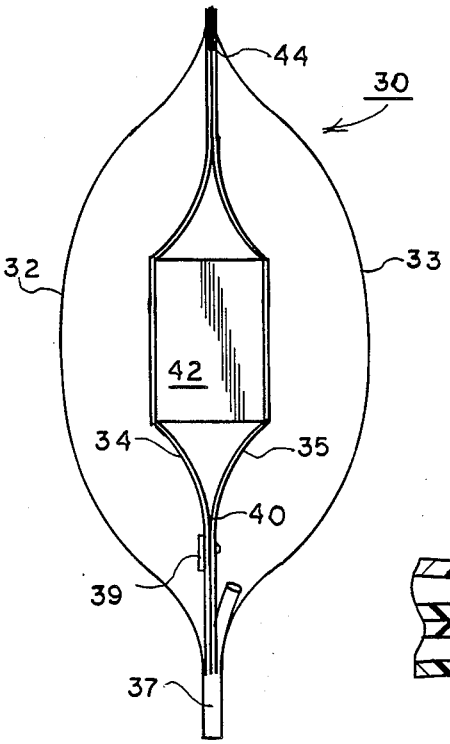
Figure 3:
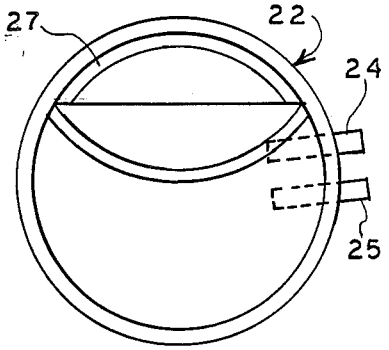
Figure 5:
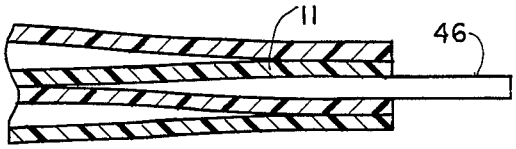
Figure 6C:
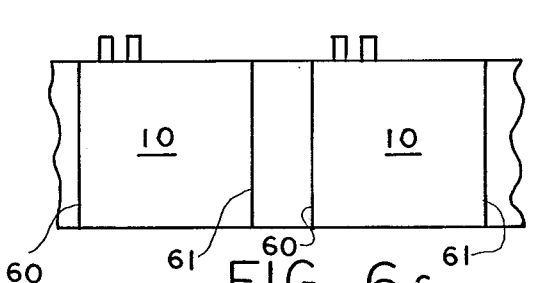
Figure 6B:
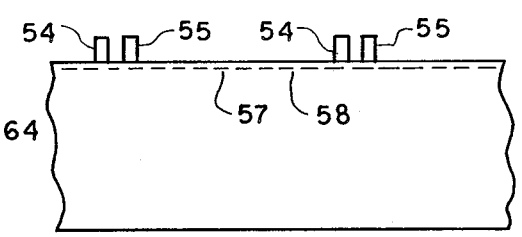
Figure 6A:
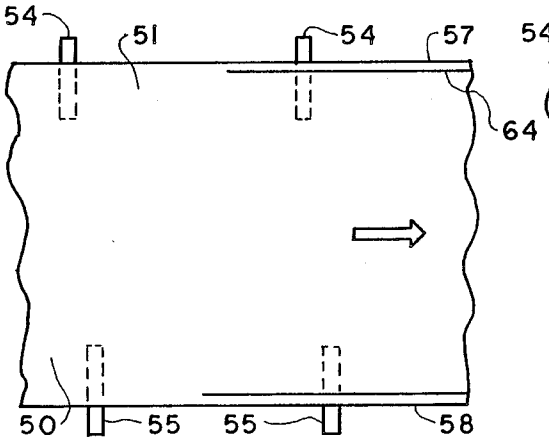
Figure 7:
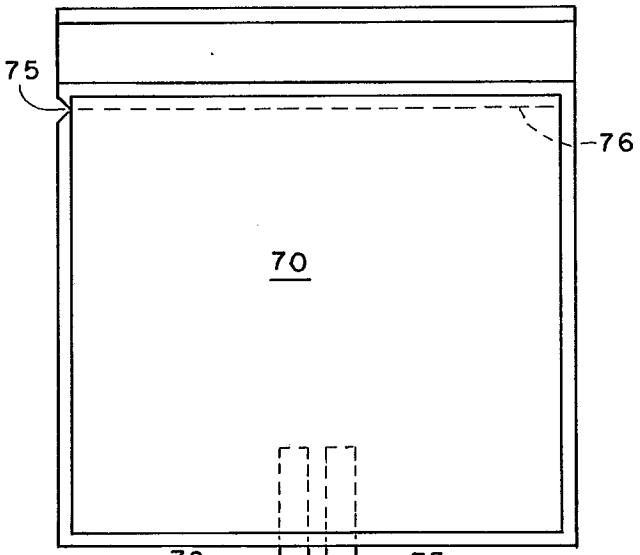

FIG. 3 a plan view of is another embodiment of the invention;

FIG. 4 is a vertical sectional view showing an article contained in the package of FIG. 1;

FIG. 5 is a cross-sectional view showing the use of an inflation tube;

FIGS. 6A, 6B and 6C illustrate sequential steps in carrying out the method of the present invention;

FIG. 7 is an elevational view of another embodiment of the invention; and

Figure 8:
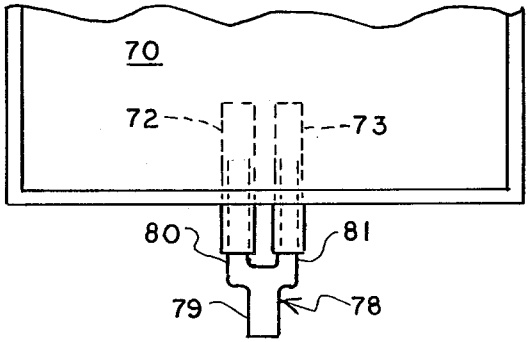

FIG. 8 is a fragmentary elevational view of another embodiment of the invention.

DETAILED DESCRPTION OF A PREFERRED EMBODIEMENT OF THE PRESENT INVENTION

Figure 2:
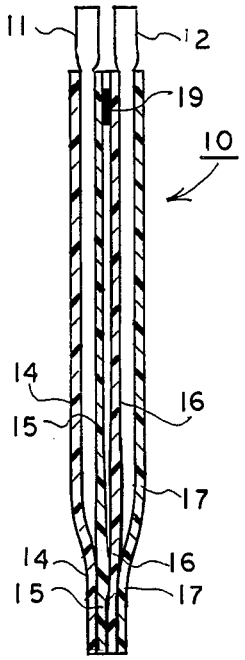
FIG. 2 is an enlarged fragmentary cross-sectional view taken along the line 2—2 of FIG. 1.

Referring particularly to FIGS. 1 and 2 there is shown an inflatable bag 10 of rectangular configuration embodying the present invention. A pair of inflation tubes 11 and 12 extend from locations within the bag to adjacent locations outside one the upper edges of the bag 10 as shown in FIG. 1. The inflation tubes 11 and 12 are disposed in proximity with one another to enable a person to place both tubes in his mouth at the same time and simultaneously inflate the two compartments of the package as described more fully herein.

The bag 10 comprises four sheets of plastic films 14, 15, 16 and 17. Along the lower and side edges of bag 10 as viewed in FIG. 1 all four sheets 14, 15, 16 and 17 are heat sealed together. Along the upper edge which constitutes the mouth of the bag into which articles to be packaged are inserted, the sheets 14 and 15 are heat sealed to one another and the sheets 16 and 17 are heat sealed to one another, but the inner sheets 15 and 16 are not sealed together. The inflation tubes 11 and 12 extend through the heat sealed edges into the respective spaces between the sheets 14 and 15 and the sheets 16 and 17. These spaces are otherwise sealed from the ambient. The inflation tubes 11 and 12 extend a substantial distance into these spaces and being formed of a very soft flexible material such as vinyl, provide check valves or unidirectional valve means within these spaces which prevent gas from passing outwardly through the tubes 11 and 12. However, the ends of the tubes 11 and 12 which are located outside of the bag may be opened and exhaled into to inflate the compartments between the sheets 14 and 15 and the sheets 16 and 17.

A double sided adhesive tape 19 is provided between the inner sheets 15 and 16 near the upper or fourth edge of the bag to permit sealing of the mouth of the bag after an article to be packaged has been placed therein. The proximity of the inflation tubes 11 and 12 is important since it enables the inflation of both compartments simultaneously without the use of special equipment or the like. Preferably the double sided adhesive tape 19 is attached during the manufacture of the bag to one of the inner sheets 15 and 16, and the other surface of the double sided adhesive tape is covered with a removable strip which remains on the tape until the user has inserted an article in the package and desires to seal off the mouth of the bag.

FIG. 3 is an illustration of another embodiment of the invention which comprises a generally circular bag 22 having a pair of inflation tubes 24 and 25 located in proximity to one another along one edge of the bag and a mouth for the central compartment extending approximately through an arcuate distance of forty five degrees. A double sided adhesive tape or other suitable closure material 27 is provided on one of the inner sheets along the mouth of the bag. The basic construction of the bag 22 is the same as the bag 10 it being provided with two external inflatable compartments into which the inflation tubes 24 and 25 respectively extend and a central compartment for receiving an article to be packaged.

Referring to FIG. 4, there is illustrated another embodiment of the invention in use. In the embodiment of FIG. 4 a bag 30 is shown to include a pair of outer gas impervious sheets 32 and 33 and a pair of inner gas impervious sheets 34 and 35. As in the bag 10, the outer sheets are sealed together throughout a continuous area and a single inflation tube 37 extends into the space between the outer sheet 33 and the inner sheet 35. A unidirectional valve 39 is positioned over a pair of aligned openings in the inner sheets 34 and 35 located a short distance from one of the sealed edges of the bag. The sheets 34 and 35 are also sealed together at the location 40 inwardly of the valve 39 to prevent the leakage of air from the inflatable outer compartments into the inner compartment between the sheets 34 and 35 in which an article 42 is shown in the packaged state. The inner sheets 34 and 35 are suitably closed by a double sided adhesive strip 44. In this embodiment of the invention as the user exhales into the inflation tube 37 the two compartments respectively located between the outer sheet 32 and the inner sheet 34 and the outer sheet 33 and the inner sheet 35 are simultaneously inflated. In this embodiment, however, if the inflation tube 37 is opened by, for example, inserting a tube therethrough, only the compartment between the outer sheet 33 and the inner sheet 35 will be deflated. However, once one of the compartments is inflated and the inner compartment is opened along the location of the strip 44 it is a simple matter to remove the article 42. Of course, if both compartments are inflated then it is difficult to remove the article since it remains confined between the two inflatable compartments.

After the packages of FIGS. 1, 3 and 5 have been inflated by the user and an article is packaged therein, the portions of the inflation tubes which extend outwardly from the edges of the associated packages may be cut off by the use of a scissors. If desired, a notch may be provided in each of the tubes adjacent to the edge of the bag to facilitate tearing of the tube along a line extending perpendicular to the longitudinal axis of the tube and intersecting the notch. By removing the extending tube the package has a more attractive appearance if it is used, for example as a gift wrap.

The sheets which form the package are preferably formed of polyethylene, which is a heat sealable material,so that the edges of the package can be readily heat sealed together. To provide a better gas barrier, other plastic material such as Saran, Nylon and polyester may be used and may be coated with a thin layer of metal which will also improve the appearance of the bag if it is to be used for gift wrapping or the like.

If it is desired to deflate a package without damage to the package itself, a thin tube such as a drinking straw 46 as shown in FIG. 5 may be inserted into the outer end of the inflation tube 11 or any of the other inflation tubes, and if inserted completely through the tube into the associated compartment the gas in that compartment will escape through the tube 46 and thereby permit the compartment to deflate.

Referring to FIG. 6, there is shown a sequence of steps which may be used in manufacturing the bag shown in FIGS. 1 and 2. A pair of inflation tubes 54 and 55 are placed on top of the sheet 50 with the tube 54 extending a short distance from one edge, the top as shown in FIG. 6 and the tube 55 extending a short distance from the opposite edge. A second plastic sheet 51 is superimposed on the first sheet 50 over the tubes 54 and 55.

The superimposed sheets are then passed through a heat sealing operation where the sheets 50 and 51 are sealed along the top and bottom edges. In that same operation the tubes 54 and 55 are heat sealed to the sheets 50 and 51.

After the heat sealing operation is completed the entire assembly is folded on itself along its longitudinal center line so that the bottom edge is superimposed on the top edge. The folded over sheets are then passed through another sealing and cutting station wherein the sheets are cut and sealed along lines 60 and 61 to provide the final bag. At this same time the four sheets are heat sealed together along the bottom edge.

The double sided tape or other closure means for closing the pocket of the bag may be added at this time or if desired a double sided tape 64 may be applied to the upper surface of the web 51 prior to the folding operation shown in FIG. 3. The position of the adhesive strip 64 along the upper edge of the web is illustrated in FIG. 6. The individually cut and heat sealed bags may be transferred to shipping containers or the like.

Referring to FIG. 7, there is illustrated another embodiment of the invention. In this embodiment there is shown a bag 70 which has the same general configuration as the bag 10, but in this case a pair of inflation tubes 72 and 73 extend through the edge of the bag opposite the opening to the inner compartment and are centrally located between the vertical edges of the bag. The four sheets making up the pouch 70 are formed of a biaxially oriented material, and a notch or slit 75 extends through all four sheets at one of the vertical edges in proximity to the mouth of the inner compartment. With this embodiment of the invention when it is desired to remove an article which has been packaged in the bag 70 and the outer compartments have been inflated it is merely necessary to tear off the upper portion of the bag along a line 76 which extends from the notch 75. In this manner all three compartments are simultaneously opened so that the article can be quickly removed from the inner compartment.

In order to facilitate inflation of the two compartments in the bag 70 there is provided in accordance with another feature of the present invention a generally tubular mouthpiece 78 which has one tubular portion for insertion into the mouth of the user and a pair of branch conduits 80 and 81 which are adapted to be inserted a short distance into the ends of the inflation tubes 73. Using the mouthpiece 78, the two compartments can be more easily and quickly inflated simultaneously to insure that the article is properly located between the two. I have found that it is preferable to inflate both compartments simultaneously for optimum protection of the article being packaged.

While the present invention has been described in connection with particular embodiments thereof, it will be understood by those skilled in the art that many changes and modifications may be made without departing from the true spirit and scope of the present invention. Therefore, it is intended by the appended claims to cover all such changes and modifications which come within the true spirit and scope of the present invention.

What is claimed:

1. An inflatable bag, comprising in combination a first sheet of a gas impervious flexible material, a second sheet of a gas impervious flexible material, said first and second sheets being sealably joined together to provide a first sealed chamber disposed between said first and second sheets, a first inflation tube means extending into said first sealed chamber between said first and second sheets for inflating said first chamber, a third sheet of a gas impervious flexible material a fourth sheet of a gas impervious flexible material, said third and fourth sheets being sealably joined together to provide a second sealed chamber disposed between said third and fourth sheets, a second inflation tube means extending into said second chamber between said third and fourth sheets for inflating said second chamber, said first and second inflation tubes being mutually adjacent to permit a person to blow into both of said tubes simultaneously, first and second check valve means respectively incorporated in said first and second inflation tube means internally of said first and second compartments for preventing the flow of gas from said first and second chambers through said first and second tube means, said second and third sheets being bonded together to partially enclose a third chamber located between said second and third sheets to receive one or more articles to be bagged, and locking means for locking said second and third sheets together to complete the enclosure of said third chamber.

2. An inflatable bag according to claim 1 wherein the portions of said inflation tube means disposed externally of said chambers are adapted to be severed from the remainder of the associated tube in proximity to the adjacent edges of said sheets.

3. An inflatable bag according to claim 1 wherein said first and fourth sheets have a metallic outer surface.

4. An inflatable bag according to claim 1 wherein said locking means comprises a double sided adhesive tape.

5. An inflatable bag according to claim 1 wherein said locking means comprises mutually interlocking strips respectively bonded to said second and third sheets.

6. A method of making an inflatable bag, comprising the steps of placing first and second flat tubular plastic members between two superimposed sheets of an impervious flexible material with said members extending outwardly from opposite edges of said sheets, applying an adhesive tape to one of said sheets in proximity to one of said edges thereof, folding said sheets over with said opposite edges in juxtaposition and said members in mutual proximity to position said adhesive tape at the other edge of said one sheet, and sealing together portions of said folded sheets to provide first and second sealed chambers between said two superimposed sheets and a third chamber between the folded over portions of said one sheet.

7. A method of making inflatable bags, comprising the steps of superimposing four webs of gas impervious flexible material, inserting tubular, unidirectional valve members between the top and bottom webs and the next adjacent webs with said valve members extending outwardly from the edges of said webs, sealing together continuous edge areas of said top and bottom webs and the next adjacent webs to define two sealed chambers into which said valve members extend, sealing said inner sheets together in proximity to said edge areas to provide between said inner sheets a partially enclosed chamber, and attaching to one of said inner sheets a sealing strip for subsequent attachment to the other of said inner sheets to substantially complete the enclosure of said partially enclosed chamber.

* * * * *